United States Patent [19]

Lavon

[11] 4,289,275

[45] Sep. 15, 1981

[54] METHOD AND DEVICE FOR BREAKING A HARD COMPACT MATERIAL

[75] Inventor: Erik V. Lavon, Saltsjö-Boo, Sweden

[73] Assignee: Atlas Copco Aktiebolag, Nacka, Sweden

[21] Appl. No.: 93,910

[22] Filed: Nov. 13, 1979

Related U.S. Application Data

[62] Division of Ser. No. 805,520, Jun. 10, 1977, Pat. No. 4,195,885.

[30] Foreign Application Priority Data

Jun. 28, 1976 [SE] Sweden ..... 7607337

[51] Int. Cl.[3] ..... B05B 1/08

[52] U.S. Cl. ..... 239/101; 60/371; 299/17

[58] Field of Search ..... 239/101, 102, 93, 94, 239/99; 299/16, 17; 175/67; 60/370, 371; 222/334, 335; 137/624.14

[56] References Cited

U.S. PATENT DOCUMENTS

| | | | |
|---|---|---|---|
| 3,520,477 | 7/1970 | Cooley | 299/17 X |
| 3,601,987 | 8/1971 | Nevskogo et al. | 299/17 X |
| 3,601,988 | 8/1971 | Oblasti et al. | 299/17 X |
| 4,177,926 | 12/1979 | Hunter | 239/99 |

*Primary Examiner*—Robert B. Reeves
*Assistant Examiner*—Gene A. Church
*Attorney, Agent, or Firm*—Frishauf, Holtz, Goodman & Woodward

[57] ABSTRACT

A hard compact material, such as rock, is broken by forcing a longish mass body of relatively incompressible fluid, such as water, against the material to be broken. The mass body is caused to impact the material at a momentum necessary for breaking the material. The momentum is generated by supplying the fluid to a storage chamber against the effect of a thrust load acting upon the fluid in the storage chamber. When a sufficient amount of fluid has been supplied the fluid in the storage chamber is forced toward the material to be broken by the effect of the thrust load.

22 Claims, 11 Drawing Figures

Fig. 10
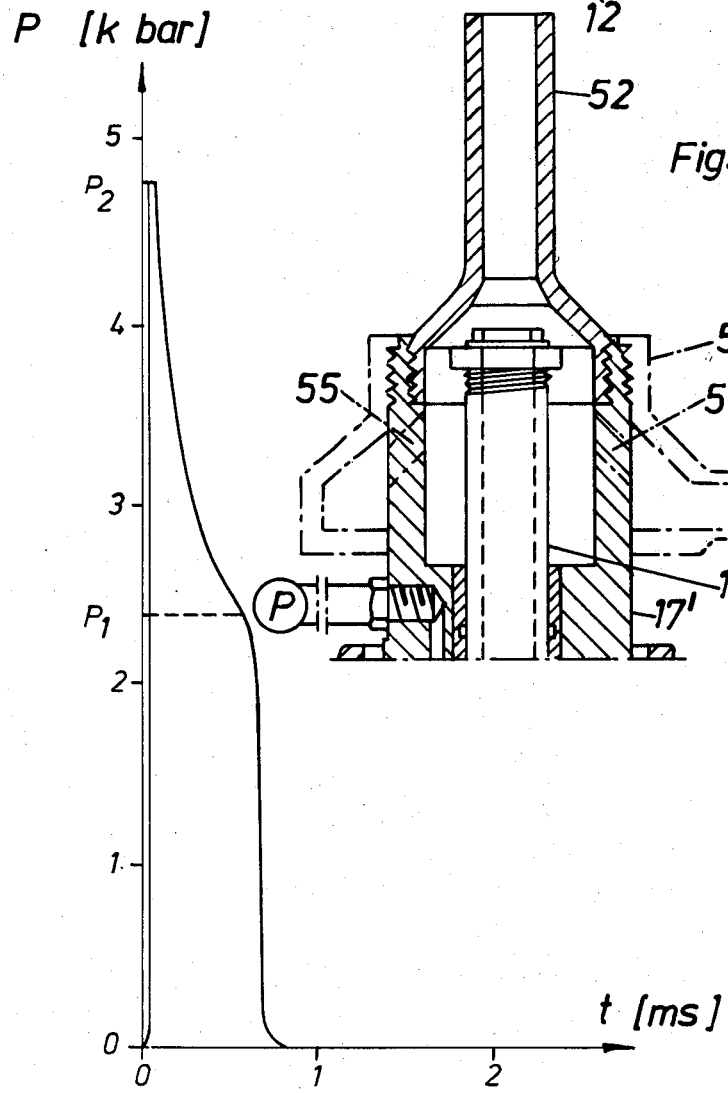
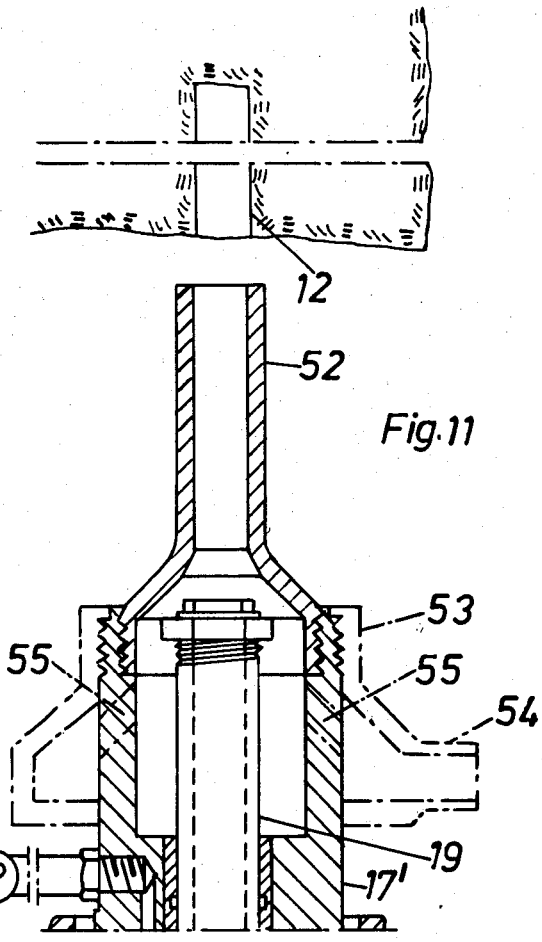
Fig. 11

METHOD AND DEVICE FOR BREAKING A HARD COMPACT MATERIAL

CROSS REFERENCE TO RELATED APPLICATION

This is a Division of prior U.S. Application Ser. No. 805,520, filed June 10, 1977, now U.S. Pat. No. 4,195,885.

BACKGROUND OF THE INVENTION

Conventional methods of rock breakage, including drilling-and-loading-and blasting and crushing techniques have several disadvantages.

The drill-and-load-and-blast technique has the disadvantage of noise, gases, dust and flying debris, which means that both men and machines must be evacuated from the working area. Crushing techniques require large forces to crush the rock and the tool wear is significant.

During the last decade serious attention has been given to replacing the drill and blast technique for tunneling, mining and similar operations. One alternative technique involves the use of high velocity jets of water or other liquid to fracture the rock or ore body and numerous devices intended to produce pulsed or intermittent liquid jets of sufficiently high velocity to fracture even the hardest rock have been suggested. As yet, however, jet cutting techniques are still unable to compete with the traditional methods of rock breakage such as drill and blast in terms of advance rate, energy consumption or overall cost. Moreover serious technical problems such as the fatigue of parts subjected to pressures as high as 10 or 20 kbar and excessive operational noise remain.

A second, and even older technique for fracturing the rock and for saturating soft rock formations such as coal with water for dust suppression involves drilling a hole in the rock and thereafter pressurizing the hole with water either statically or dynamically.

These methods are inapplicable to hard rock formations because of the restriction in working pressure which can be realized or usefully utilized with conventional hydraulic pumps. They are difficult to apply in practice particularly in soft crumbling rock or badly fissured rock in that the bore hole must be effectively sealed around the tube introduced into the hole through which the liquid is pumped. These restrictions in all make the method far less versatile than drill and blast.

In applicant's Swedish patent specification No. 7510559-3 a hydraulic breaking technique is described which makes it possible to break hard compact material such as rock by using an equipment which operates at comparatively low pressures.

SUMMARY OF THE INVENTION

This invention relates to an improvement in the breaking technique shown in Swedish patent application No. 7510559-3.

An object of the invention is to obtain a method and device of abovementioned type where the momentum, i.e. the product of the mass of the fluid body and its velocity, which is necessary for breaking is generated by supplying the fluid to a storage chamber against the action of a thrust load, whereupon the fluid in the storage chamber is forced or driven against the material by the effect of the thrust load.

Another object is to obtain a device where the forcing or launching of the fluid is controlled by the fluid itself.

A further object is to obtain a gun of the repeater-type for launching rapid series of "shots".

BRIEF DESCRIPTION OF THE DRAWINGS

The invention is described in the following description with reference to the accompanying drawings in which two embodiments are shown by way of example. It is to be understood that these embodiments are only illustrative of the invention and that various modifications thereof may be made within the scope of the claims following hereinafter.

In the drawings.

FIG. 10 is an illustration of the pressure time history of the pressure in a simulated drill hole.

FIG. 11 shows a modification of the embodiment according to FIGS. 1–5.

DETAILED DESCRIPTION OF PREFERRED EMBODIMENTS

Figure 1:
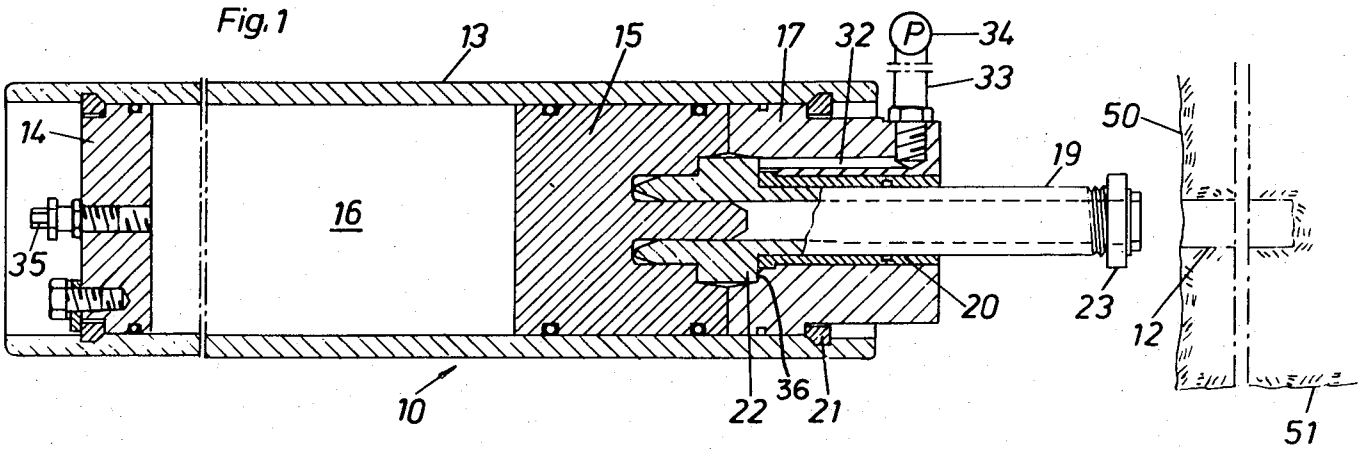
FIGS. 1–5 show in section a side view of a device according to the invention during different phases of operation.
Figure 2:
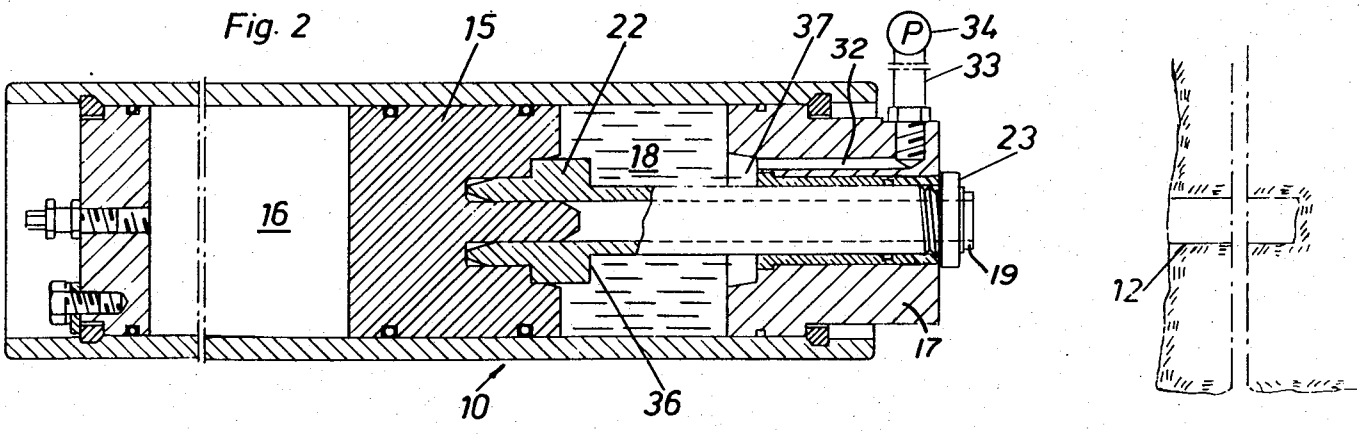

Corresponding details have been given the same reference numeral in the various figures.

In FIGS. 1–5 is shown a gun generally depicted 10 for launching fluid in form of a fluid piston or column 11 into a cylindrical blind hole 12, which is pre-drilled in the material to be broken. As examples of materials breakable according to the invention can be mentioned rock, metal ores, concrete and coal. The blind hole 12 is drilled using conventional technique. In the illustrated embodiment the fluid piston consists of water, other fluids however may be used.

The gun 10 comprises a cylinder 13 which at its rear end is closed by means of a back head 14. A drive piston 15 is reciprocable within the cylinder 13. The drive piston 15 and the back head 14 confine a rear cylinder chamber 16.

A front head 17 is mounted in the forward end of the cylinder 13. The front head 17 is prevented from being pushed out of the cylinder by a lock ring 21 which comprises several segments. The drive piston 15 and the front head 17 confine a forward cylinder chamber 18. A barrel 19 is reciprocably guided in a bushing 20 which is inserted in the front head 17. The movement of the barrel 19 is limited by a rear enlarged portion 22 on the barrel and by a stop ring 23 screwed on the forward end of the barrel.

The side of the drive piston 15 which faces the forward cylinder chamber 18 is provided with an annular stepped recess. The annular stepped recess comprises an inner annular chamber 24 and an outer annular chamber 25 having larger outer diameter, see FIG. 4. The annular recess 24, 25 surrounds a central pin 26. At its forward end the pin 26 has a bevelled side surface 27. The portion 28 of the barrel which projects rearward from the enlarged portion 22 has at its rear end bevelled inner and outer side surfaces 29, 30. The enlarged portion 22 can be pushed into the chamber 25 to rest against an annular surface 31 while at the same time the rear barrel portion 28 is pushed into the chamber 24.

The forward cylinder chamber 18 provides a storage chamber for the fluid before the fluid is admitted into the barrel 19. The fluid is supplied to the storage chamber through a passage 32 which is connected to a high pressure pump 34 via a hose 33.

The forward cylinder chamber 18 is provided with an annular chamber 37. The chamber 37 works as a retard chamber for the enlarged portion 22 so that the barrel 19 is retarded hydraulically during the end of its movement forwards.

The rear cylinder chamber 16 is charged with compressed gas, such as pressure air or nitrogen. The compressed gas acts upon the drive piston 15 which transmits this thrust load to the fluid in the storage chamber 18. The cylinder chamber 16 can be connected to a pressure source, such as a compressor, by means of a connection nipple 35 in the back head 14.

Figure 3:
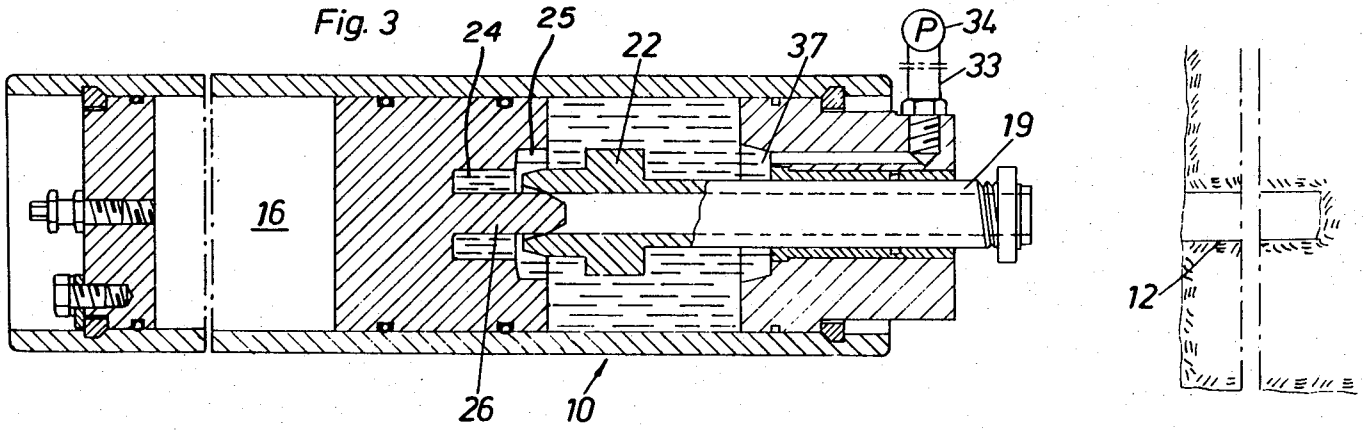

The gun shown in FIGS. 1–5 operates as follows:

In FIG. 1 the drive piston 15 and the barrel 19 are shown in their position when the barrel is directed toward a hole 12. Upon completed adjustment the pump 34 is started, whereupon the fluid is supplied to the passage 32. The fluid pressure acts upon an annular surface 36, see FIG. 2, on the enlarged portion 22. The barrel 19 and the drive piston 15 are then forced backwards against the action of the gas spring in the rear cylinder chamber 16, i.e. the fluid is successively supplied to the storage chamber 18 against the effect of the thrust load acting upon the fluid in the storage chamber. After a short displacement the enlarged portion 22 leaves the retard chamber 37 which means that the fluid pressure also acts directly upon the drive piston 15. The barrel 19 and the drive piston 15 are pushed backwards during compression of the gas in the rear cylinder chamber 16 and storing of energy in the gas. When the stop ring 23 is retarded against the front head 17 the barrel is locked against a continued backward movement, FIG. 2. The drive piston 15 is now pushed backwards alone. When the enlarged portion 22 leaves the chamber 25 fluid is allowed to flow therein. Shortly afterwards the rear portion 28 of the barrel leaves the chamber 24, whereupon fluid also flows into this chamber. The fluid, however, is prevented from being admitted into the barrel due to the pin 26 which still closes the barrel. When the fluid is admitted into the chamber 24 the barrel 19 is forced forwards. After a short movement of the barrel the pin 26 leaves the bore of the barrel. FIG. 3 shows the position where the admission of fluid into the barrel is started.

Figure 4:
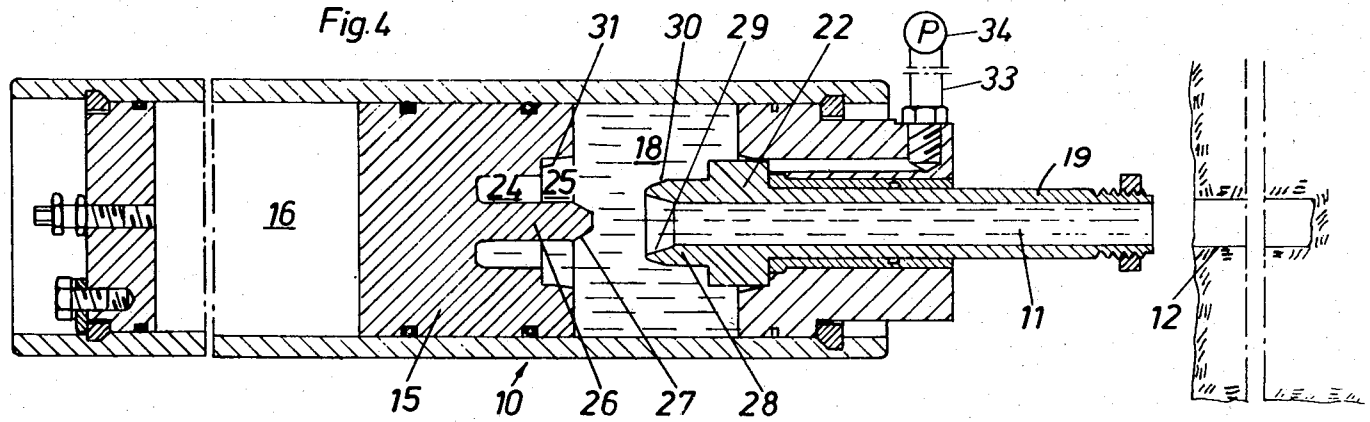

The barrel 19 is now rapidly driven forwards and is retarded when the portion 22 reaches the retard chamber 37, FIG. 4. Thus, the fluid is forced through the barrel 19 due to the thrust load acting upon the fluid in the storage chamber 18. In the barrel 19 the fluid is formed as a fluid piston 11. The fluid piston is accelerated as a coherent longish mass body and is directed and launched into the hole 12 to impact the bottom of the hole.

Figure 5:
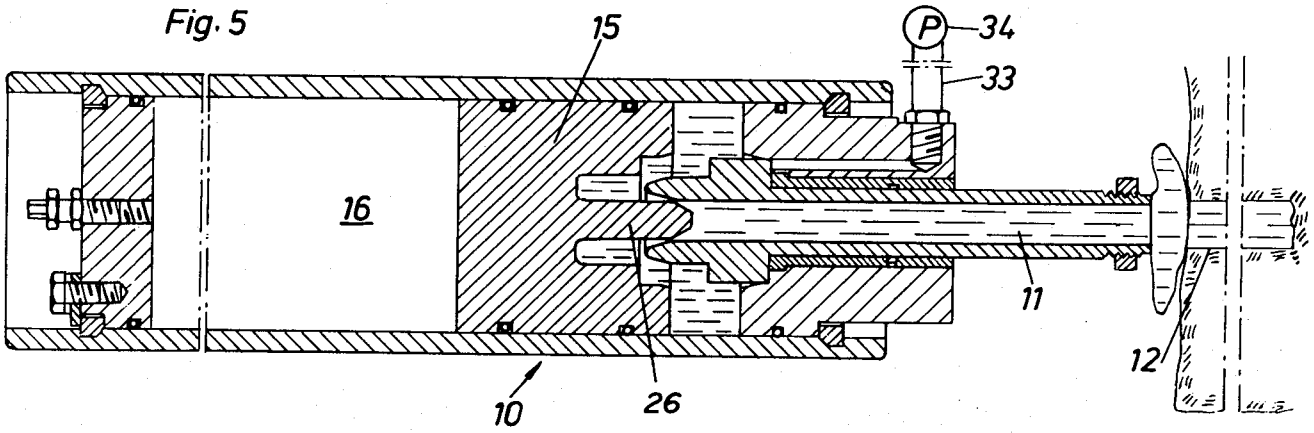

FIG. 5 shows the position where the pin 16 reaches the bore of the barrel which means that the retardation of the drive piston 15 is started. The remaining fluid in the cylinder chamber 18 is used to hydraulically retard the drive piston 15. In order to prevent rebounce of the drive piston 15 the remaining fluid has to be forced through the annular clearance between the pin 16 and the bore of the barrel 19 via the annular chambers 24, 25. By suitable adaption of the annular clearance relative to the energy stored in the drive piston and to the amount of remaining fluid in the cylinder chamber 18 and the annular chambers 24, 25 the drive piston is retarded gently. FIG. 1 shows the final position after a "shot".

The clearance between the barrel 19 and the drive piston 15 is of great importance to the operation of the gun. In order to obtain the above described function the clearance between the bevelled surfaces 27, 29 on the pin 26 and the barrel, respectively, has to be smaller than the clearance between the bevelled surface 30 on the barrel and the outer surface of the annular chamber 24. The latter clearance in its turn has to be smaller than the clearance between the enlarged portion 22 and the outer surface of the annular chamber 25. By this is obtained a continuously increasing restriction of the fluid in its direction of flow.

By making the clearance between the pin 26 and the bore of the barrel larger, for instance by making the pin 26 shorter, the gun can be designed to launch two "shots", the second following immediately after the first one. This is caused by the fact that the drive piston 15 reaches the barrel 19 before the barrel is retarded in the retard chamber 37. When reaching the barrel the drive piston delivers an impact thereto so that the drive piston and the barrel once again are separated.

To advantage the gun can be designed as a gun of the repeater-type. Then the hose 33 is connected to a continuously operating pump. When the barrel 19 and the drive piston 15 reach the position shown in FIG. 2 the next pump stroke produces the "shot". The pump continues to operate until next "shot" is fired and so on. Consequently, series of "shots", the next following shortly after the preceding one, are fired into the hole. The first "shot" may produce cracks when it impacts the hole bottom whereupon the following "shots" drive the cracks until they reach a free surface of the material; the surface 50 when breaking according to the crater lasting mode or the surface 51 when breaking according to the bench blasting mode, see FIG. 1. It should be stressed that the series of "shots" are fired automatically as long as the pump operates, thus without any intervention of the operator.

The amount of launched fluid can easily be varied by means of the stop ring 23 which defines the rear turning position of the barrel 19.

In FIG. 11 is shown a modified front part of the embodiment according to FIGS. 1–5. The front head 17[1] is prolonged fowards to about the outermost position of the barrel 19. An extension barrel 52 is screwed to the prolonged front head 17[1]. The inner diameter of the extension barrel 52 is substantially the same as that of the barrel 19. The extension barrel 52 facilitates aligning of the gun with the hole 12 and serves as a guard to protect the movable barrel 19 against mechanical damages by preventing the barrel 19 from abutting the rock.

In cases where the hole 12 has a tendency to be waterfilled it may be desired to evacuate the hole before shooting. For that purpose a hood 53 can be screwed on the front head 17[1]. Pressure air is admitted into the hood 53 through an inlet 54 and is blown into the hole 12 via passages 55 in the front head 17[1] and the extension barrel 52.

In the embodiment of the gun shown in FIGS. 6–9, generally depicted 40 the barrel 19 is firmly connected to the front head 17. A rod 41 is displaceably guided relative to the drive piston 15. The relative displacement between the rod 41 and the drive piston 15 is limited by a stop ring 42 screwed on the rod 41 and an enlarged portion 43 on the rod 41. The drive piston 15 is provided with an annular chamber 44 which is dimensioned for receiving the enlarged portion 43. A pin 45 projects from the portion 43. The front head 17 is provided with a recess which corresponds to the enlarged portion 43 and the pin 45 and which recess comprises an annular chamber 46 and a conical chamber 47.

Figure 6:
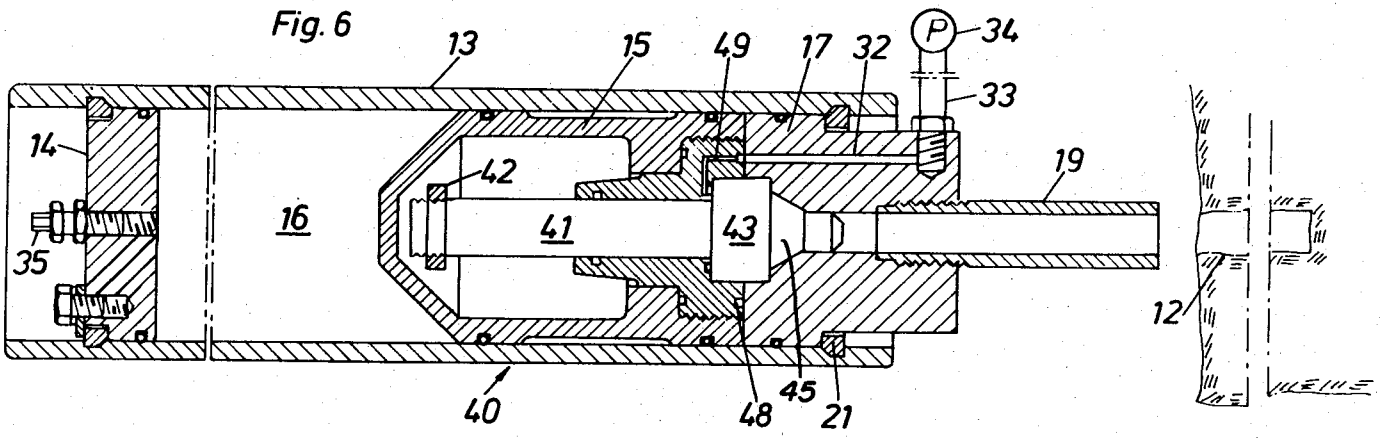
FIGS. 6–9 show in section a side view of another embodiment according to the invention during different phases of operation.

The gun shown in FIGS. 6–9 operates as follows:

In FIG. 6 the drive piston 15 and the rod 41 are shown in their position during the adjustment of the barrel 19 to alignment with the hole 12. Upon completed adjustment the pump 34 is started, whereupon the fluid is admitted into the passage 32. The fluid pressure is distributed uniformly over the surface of the drive piston 15 by means of an annular groove 48. After a short displacement of the drive piston 15 the fluid pressure is caused to act upon the entire area of the drive piston 15. During successive fluid admission the drive piston 15 is forced backwards against the action of the thrust load caused by the gas spring 16. In order to safeguard that the rod 41 remains in the position shown in FIG. 6 the fluid pressure is transferred through a passage 49 to act upon a rear ring surface on the enlarged portion 43 of the rod 41.

Figure 7:
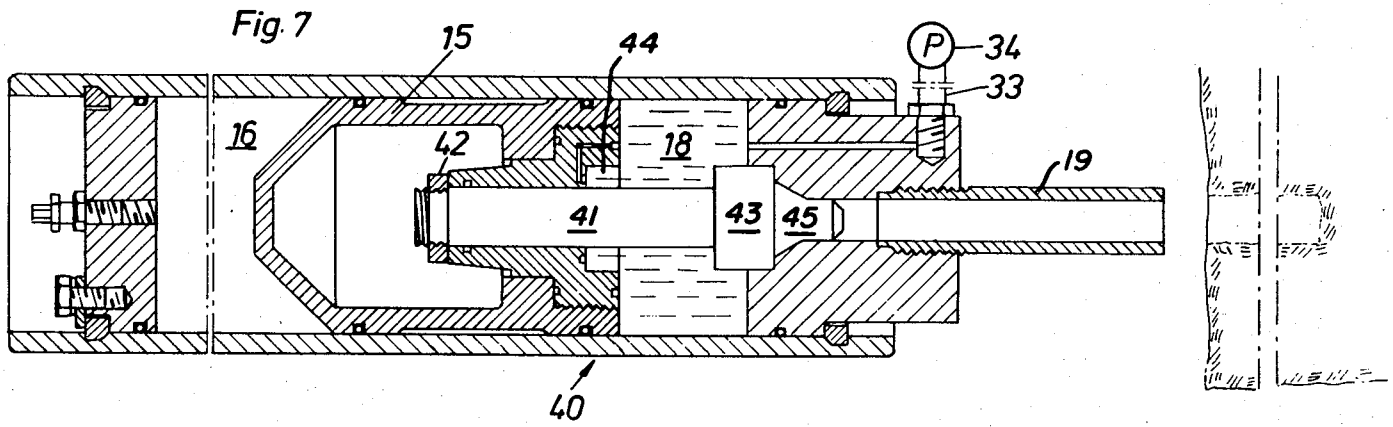
Figure 8:
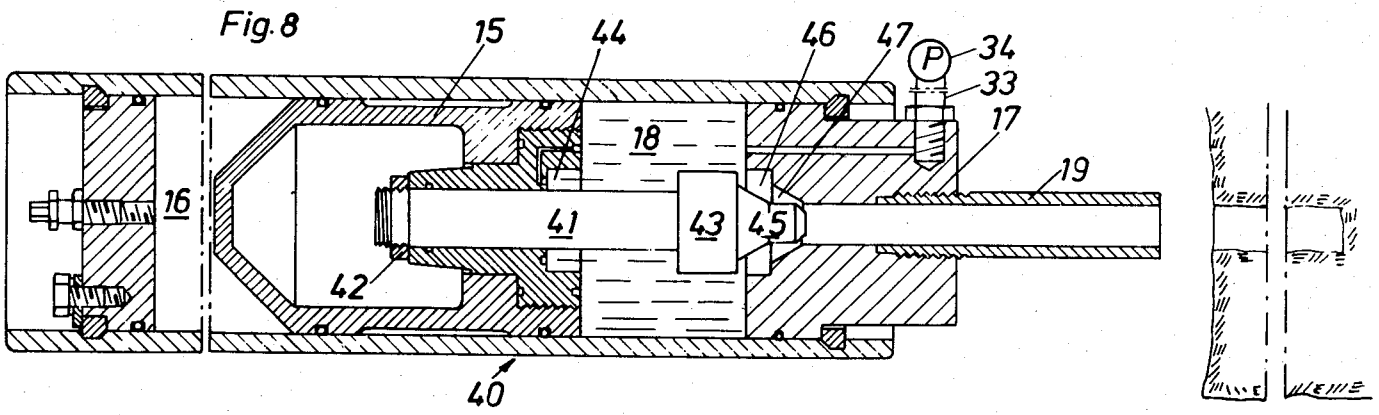

When the drive piston 15 reaches the stop ring 42, FIG. 7, continued fluid supply will cause the portions 43, 45 of the rod 41 to be drawn out of the recess 46, 47 in the front head 17, FIG. 8. Then the thrust load acting upon the fluid in the storage chamber 18 forces the fluid through the barrel 19 via the chambers 46, 47. The rod 41 remains in its position shown in FIG. 8 due to the pressure difference over the portion 43.

Figure 9:
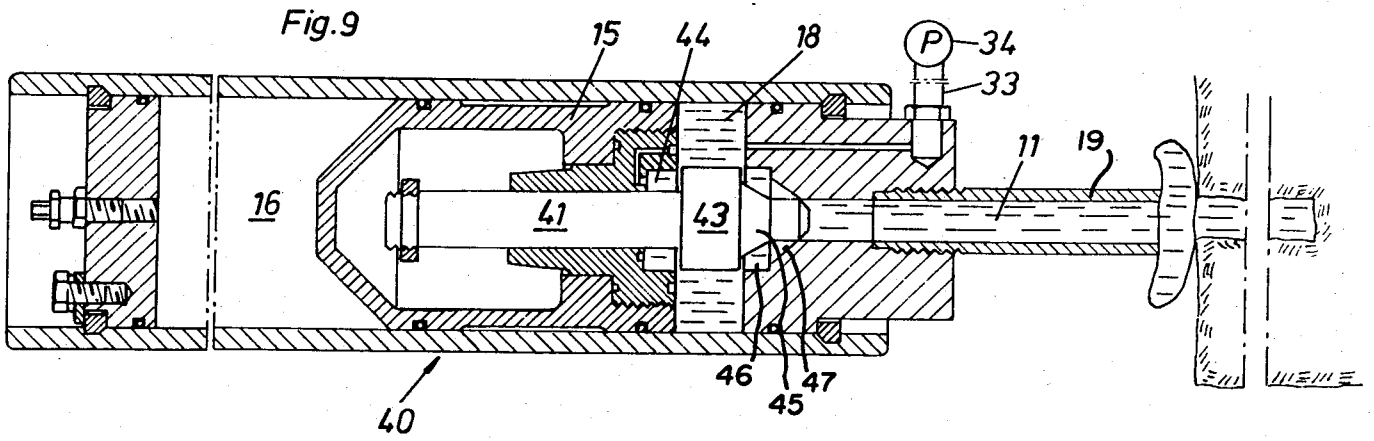

FIG. 9 shows the position where the drive piston 15 reaches the enlarged portion 43 of the rod 41. The drive piston 15 is retarded hydraulically by the fluid in the retard chamber 44 and by the remaining fluid in the storage chamber 18. In order to obtain a gentle retardation of the drive piston 15 and prevent rebounce thereof the clearance between the annular chamber 44 and the enlarged portion 43 should be larger than the clearance between the portion 43 and the annular chamber 46. This latter clearance in its turn should be larger than the clearance between the cylindrical front end of the pin 45 and the bore of the barrel. By this is achieved a continuously increasing restriction of the fluid flow in its direction of flow.

When required the volume enclosed in the drive piston 15 may be drained through a passage, not shown, in the rod 41. Alternatively the drive piston 15 may be designed without this hollow. In this case the pressure gas acts upon the drive piston as well as against the rod 41.

In applicant's Swedish patent specification No. 7510559-3 there are stated conditions which must be met in order to obtain accurate breakage. This theory, however, does not consider the effect caused by compression of the air volume enclosed between the fluid column and the bottom of the hole. In order to look into this effect the pressure in a simulated drill hole has been studied. In FIG. 10 the pressure taken in diagram is illustrated. Water in form of a longish mass body was forced into a 500 mm deep solid iron tube with 23 mm diameter. The bottom of the tube was closed. A gun of the type shown in FIGS. 1–5 was used. When the fluid column impacted the bottom of the tube the overall length of the fluid column was about 800 mm. The impact velocity against the bottom was about 170 m/sec. The ratio between the diameter of the pipe and the inner diameter of the tube was 0.956. The so-called liquid impact pressure, i.e. $p=\rho CV$ where $\rho$ is the density of the liquid, C is the sound speed in the liquid and V is the velocity of the liquid when it strikes the bottom of the hole, which is generated in the bottom of the hole becomes about 2.4 kbar, $P_1$ in FIG. 10. As shown in FIG. 10 the actual pressure is higher than this liquid impact pressure. This difference is probably caused by the explosive expansion of the air volume which is compressed by the water column in the tube. High speed filming of the process indicates that the compressed air is taken up and distributed in the water column when the column strikes the bottom of the hole. The expansion energy of the compressed air is superposed the energy stored in the water column. Thus it is evident that a possible compression of the enclosed air volume in a drill hole affects the breaking process favorably, particularly concerning the generating of cracks which are required for the breaking. In the pressure time history illustrated in FIG. 10 the tube was so strong that it was not broken when the water stroke against its bottom. In practice the pressure diagram is more complicated. Particularly, the occurrence of natural cracks in the material decreases and sometimes substantially completely eliminates the effect of the compression of the air. Further, this effect is decreased by a smaller relative area ratio between fluid column and hole.

In our Swedish patent specification No. 7510559-3 is described how the propagation of cracks may be caused to take presedence in different directions in order to achieve directed fracture or break effect. The gun described in this application can to advantage be mounted together with a conventional rock drilling machine on a rig of the type described in Swedish patent specification No. 7510559-3. In such a rig the gun and the rock drilling machine can be arranged movably on the feed bar in the latitudinal direction thereof or turnably about an axis which is parallel with the feed bar.

Several experiments have been made with the abovedescribed devices. For example blocks of limestone and granite, in size of about 1 m×1 m×1 m, have been broken by means of the gun shown in FIGS. 1–5. A 500 mm deep blind hole with 23 mm diameter was drilled in the blocks. The length of the barrel was 300 mm. A coherent water column having a length of about 800 mm was forced or driven against the bottom of the hole. The impact velocity of the water column was about 170 m/sec and its kinetic energy about 6 kilojoule. Depending on the orientation of the holes with respect to inhomogeneities in the blocks these were broken completely after varying number of "shots", generally 1 to 3. If the cracks which are generated by the first "shot" did not reach a free surface, following "shots" did cause the cracks to be driven further.

In the illustrated embodiments the fluid piston or column is forced into a pre-drilled hole. This mode of operation has the best efficiency. However, sometimes breaking can be carried out without these holes. In such cases the gun preferably should be directed in suitable manner relative to the configuration of the material. This mode of operation, however, makes greater demands upon the skill of the operator.

Alternatively the admission of fluid into the barrel from the storage chamber can be controlled by means of a conventional valve provided with an individual control circuit.

In another alternative embodiment the fluid admission into the barrel is regulated by means of a valve means which is controlled by the pressure in the storage chamber in such way that the valve means is put out of operation when the pressure exceeds a certain value. Such valve means may be a burst plate which is splittered by the pressure. Particularly the valve means may consist of a capsule containing an explosive.

The method of generating a momentum in a fluid according to the invention is generally applicable and can therefor be used also in equipments for generating high-velocity jets of fluid.

I claim:

1. A cannon for shooting an elongated fluid mass body of a relatively incompressible fluid comprising:

a storage chamber for storing the fluid, means operatively associated with said storage chamber for substantially continuously exerting a thrust load upon the fluid in said storage chamber, means for successive supply of said fluid to said storage chamber against the effect of said thrust load, a barrel means coupled to said storage chamber for forming fluid received from said storage chamber into an elongated coherent fluid mass body, and valve means which includes two cooperating members coupled between said storage chamber and said barrel means, and means for causing said valve means to suddenly open a passage between said storage chamber and said barrel means to permit the fluid from said storage chamber to be discharged through said barrel means as said elongate mass body, said means for causing said valve means to suddenly open comprising means for accelerating said two cooperating members of said valve means relative to one another, said valve means being arranged to open said passage only after said two cooperating members have moved relative to each other a predetermined distance, the maximum pressure in said storage chamber during said discharge of fluid from said storage chamber being of the same order of magnitude as the maximum pressure during the supplying of fluid to said storage chamber.

2. A cannon according to claim 1, wherein said means for causing said valve means to suddenly open further comprises means responsive to a predetermined amount of fluid supplied to said storage chamber for causing said valve means to suddenly open when a predetermined amount of fluid has been supplied.

3. A cannon according to claim 1, wherein said means for exerting a thrust load upon the fluid in said storage chamber comprises a drive piston and means for exerting a bias load on said drive piston.

4. A cannon according to claim 3 wherein means for exerting said bias load on said drive piston comprises a gas spring.

5. A cannon according to claim 3, wherein said barrel means is movable relative to said storage chamber in the driving direction of the fluid mass body.

6. A cannon according to claim 4 or 5, wherein said cooperating member of said valve means are respectively associated with said barrel means and with said drive piston.

7. A cannon according to claim 5, wherein said drive piston and said barrel means are adapted to be moved together in a backward direction opposite to the working direction of said drive piston upon supply of fluid to said storage chamber, and wherein said drive piston is provided with sealing means for fluid-tight cooperation with said barrel means during said simultaneous movement of said drive piston and said barrel means in said backward direction, said barrel means and said drive piston forming said cooperating members of said valve means.

8. A cannon according to claim 7, further comprising stop means adapted to limit the backward movement of said barrel means so as to initiate said valve means to open.

9. A cannon according to claim 8, wherein said stop means is axially adjustable relative to said barrel means for permitting adjustment of the amount of fluid supplied to said storage chamber before said valve means opens.

10. A cannon according to claim 6, wherein said barrel means includes means cooperating with the fluid in said storage chamber for hydraulically retarding said barrel means by said fluid in said storage chamber when said barrel means has moved a predetermined distance in the driving direction of the fluid mass body.

11. A cannon according to claim 1, wherein said valve means is of the seat-valve type and comprises an element which projects backwards from a seat, said element being provided with a limit stop, and said drive piston being provided with an abutment surface, said limit stop and abutment surface being adapted to cooperate after a predetermined movement of said drive piston against the bias load on said drive piston in order to cause said valve means to lift from its seat, said predetermined movement of said drive piston being caused by the admission of fluid to said storage chamber.

12. A cannon according to claim 2, wherein said valve means is of the seat-valve type and comprises an element which projects backwards from a seat, said element being provided with a limit stop, and said drive piston being provided with an abutment surface, said limit stop and abutment surface being adapted to cooperate after a predetermined movement of said drive piston against the bias load on said drive piston in order to cause said valve means to lift from its seat, said predetermined movement of said drive piston being caused by the admission of fluid to said storage chamber.

13. A cannon for shooting an elongated fluid mass body of a relatively incompressible fluid comprising:

a storage chamber for storing the fluid, means operatively associated with said storage chamber for substantially continuously exerting a thrust load upon the fluid in said storage chamber, said thrust load exerting means comprising a drive piston and means for applying a bias load on said drive piston, means for successive supply of said fluid to said storage chamber against the effect of said thrust load, a barrel means coupled to said storage chamber for forming fluid received from said storage chamber into an elongated coherent fluid mass body, and a slide valve means coupled between said storage chamber and said barrel means, and means for causing said valve means to suddenly open a passage between said storage chamber and said barrel means to permit the fluid from said storage chamber to be discharged through said barrel means as said elongate mass body, the maximum pressure in said storage chamber during said discharge of fluid from said storage chamber being of the same order of magnitude as the maximum pressure during the supplying of fluid to said storage chamber, said slide valve means including a valving element coaxial with said barrel means and a cooperating element, said valving element having a surface forming a seat valve with said cooperating element, said drive piston being arranged to lift said valving element from its seat when said drive piston reaches a predetermined rear position, said valving element having annular surface means arranged to accelerate said valving element away from its seat when subject to the pressure in said storage chamber upon said valving element leaving its seat, said slide valve means being arranged to suddenly open said storage chamber to said barrel means only after said valving element has moved a predetermined distance from its seat.

14. A cannon according to claim 13, wherein said valving element includes a piston surface that is smaller than said annular surface means and is subject to the pressure in said storage chamber for forcing said valving element against said seat until said valving element is lifted off its seat.

15. A cannon according to claim 13, wherein said cooperating element of said slide valve means comprises said barrel means.

16. A cannon according to claim 14, wherein said valving element is slidably carried by said drive piston, said drive piston having means for axial engagement with said valving element to selectively lift said valving element from its seat.

17. A cannon according to claim 13, wherein said cooperating element of said slide valve means comprises said drive piston.

18. A cannon according to claim 1 or 13, wherein said relatively incompressible fluid is water.

19. A cannon according to claim 1 or 13, wherein the maximum pressure in said storage chamber during said discharge of fluid from said storage chamber is substantially the same as the maximum pressure during the supplying of fluid to said storage chamber.

20. A cannon according to claim 13, wherein said barrel means is movable relative to said storage chamber in the driving direction of the fluid mass body.

21. A cannon according to claim 13, wherein said barrel means includes means cooperating with the fluid in said storage chamber for hydraulically retarding said barrel means by said fluid in said storage chamber when said barrel means has moved a predetermined distance in the driving direction of the fluid mass body.

22. A cannon according to claim 13, wherein said barrel means is movable relative to said storage chamber in the driving direction of the fluid mass body, and wherein said drive piston and said barrel means are adapted to be moved together in a backward direction opposite to the working direction of said drive piston upon supply of fluid to said storage chamber, and wherein said drive piston is provided with sealing means for fluid-tight cooperation with said barrel means during said simultaneous movement of said drive piston and said barrel means in said backward direction, said barrel means and said drive piston forming said cooperating members of said valve means.

* * * * *